United States Patent [19]

Roller et al.

[11] 4,331,860

[45] May 25, 1982

[54] ELECTRICAL RESISTANCE HEATING ELEMENT

[75] Inventors: Hanno Roller, Kandel; Karl-Heinz Nauerth, Erlenbach; Rudi Kitt, Herxheim, all of Fed. Rep. of Germany

[73] Assignee: Fritz Eichenauer GmbH & Co. KG, Kandel, Fed. Rep. of Germany

[21] Appl. No.: 212,417

[22] Filed: Dec. 3, 1980

[30] Foreign Application Priority Data

Dec. 3, 1979 [DE] Fed. Rep. of Germany ..... 2948592

[51] Int. Cl.[3] ..... H05B 3/02

[52] U.S. Cl. ..... 219/544; 174/52 PE; 219/505; 219/541; 219/553; 338/22 R; 338/274

[58] Field of Search ..... 219/504, 505, 523, 540, 219/541, 544, 552, 553; 338/22 R, 22 SD, 23, 316, 32 E, 274; 174/52 PE, 16 HS

[56] References Cited

U.S. PATENT DOCUMENTS

| | | | |
|---|---|---|---|
| 3,940,591 | 2/1976 | Ting | 219/544 |
| 3,996,447 | 12/1976 | Bouffard et al. | 219/541 |
| 4,091,267 | 5/1978 | Grant | 219/544 |
| 4,104,509 | 8/1978 | Van Bokestal et al. | 219/544 |
| 4,147,927 | 4/1979 | Pirotte | 219/541 |
| 4,236,065 | 11/1980 | Yashin et al. | 219/544 |

*Primary Examiner*—Volodymyr Y. Mayewsky
*Attorney, Agent, or Firm*—Craig and Antonelli

[57] ABSTRACT

Electrical resistance heating element comprising at least one heating conductor in the form of an element which is provided at opposite surfaces with an electrical contacting means and is made of a material having a positive temperature coefficient of electrical resistance (PTC element), and further comprising two substantially plane contact plates, the contact plates being held together with the PTC element interposed between them to form a single unit acting as a contact arrangement, and a sleeve of electrically insulating, heat conductive material having an inner space whose internal cross-section is adapted to the cross-section of the contact arrangement, the contact arrangement being inserted into the inner space in the sleeve under a pressure perpendicular to the plane of the contact plates. The sleeve consists of elastomeric material. With a view to achieving good and uniform heat dissipation the contact plates project a considerable distance beyond the PTC element, a spacer web portion of the sleeve being provided between them to form guide ducts into which the contact plates are inserted. These ducts may be formed to diverge in the direction of insertion of the contact arrangement. At the outer end of the sleeve, connecting leads are bonded to the ends of the contact plates and these are embedded in a holding element of insulating material. This element may be formed as a plug which closes and seals the sleeve when the contact arrangement is inserted; alternatively it may be cast into the outer end of the sleeve after insertion of the contact arrangement.

7 Claims, 2 Drawing Figures

ELECTRICAL RESISTANCE HEATING ELEMENT

Figure 1:
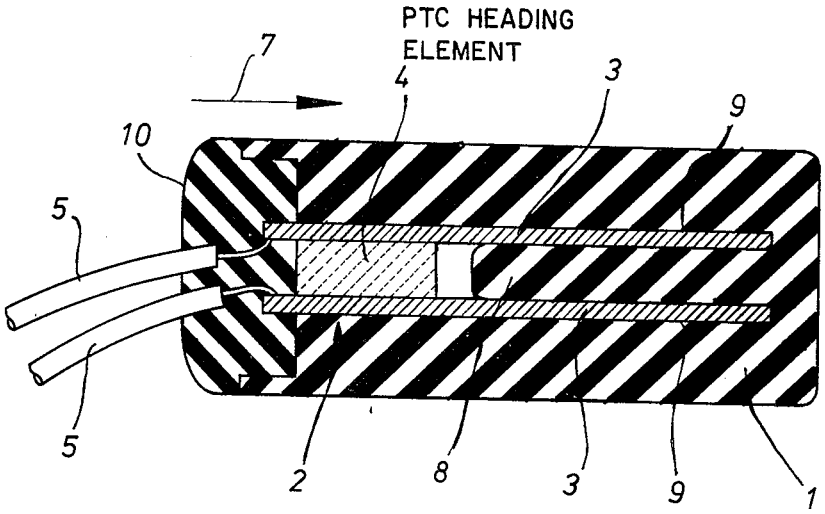

The invention relates to an electrical resistance heating element, comprising at least one heating conductor in the form of an element which is provided with electrical contacting means at opposite surfaces and which is made of a material having a positive temperature coefficient of electrical resistance (PTC element), said heating element also having two substantially plane contact plates, the contact plates being held together with the interposed PTC elements as a single structure or assembly, to constitute a contact arrangement.

In electrical heating appliances, more particularly electrically heated domestic appliances such as beverage-preparation machines (e.g. coffee making machines), fan heaters, hair dryers and so on, resistance heating elements whose heating conductors are one or more PTC elements are being used to an increasing extent instead of conventional resistance heating elements whose heating conductors consist of a metal wire. Such PTC elements are usually of prismatic form, with two opposite plane parallel surfaces and round or polygonal in plan, usually consist of a ceramic material, more particularly with a barium titanate base, and have the property that they are more-or-less self-stabilising in their electrical power consumption, since the electrical resistance increases sharply in a specific temperature range. Electrical connection to these PTC elements is usually achieved by providing the two opposite surfaces with electrical contacts in the form of a suitably applied metallised layer and connecting these to a current supply line by means of connecting elements.

In the case of PTC elements the electrical power consumption and thus the attainable heat emission depends to a substantial extent on heat dissipation and therefore on the existance of a low thermal resistance level towards the components or media which are to be heated. If there is high thermal resistance the PTC element passes into the transition temperature range in which the considerable increase in electrical resistance occurs at a low power consumption level. Thus the detrimental results of overheating are in fact avoided, but the heating power remains unsatisfactory. It follows that low thermal resistance is a desirable aim.

It is known (cf. German laid-open specification No. 26 14 433) corresponding to U.S. Pat. No. 4,147,927 to insert PTC elements into a tubular sleeve and to make the connection with elastic bars which are used for heat dissipation at the same time. It is also known (cf. German published specification No. 26 41 894 corresponding to U.S. Pat. No. 4,104,509) to connect the PTC elements with connection wires, for example by soldering, and to embed them in a housing with a heat-conducting, electrically insulating compound. These known measures can be carried out only with relatively considerable outlay and with considerable use of manual work, are suitable only for a very limited range of use in each case, and leave much to be desired more especially as regards discharging heat from the PTC elements.

Starting from the state of the art described above, it has already been proposed (cf. German Patent application No. P 28 45 965.6-34 and British Patent Application No. 2033709 corresponding to commonly assigned U.S. application Ser. No. 086,175, filed Oct. 18, 1979), as initially indicated, to provide as connection elements two substantially flat contact plates and to form a sandwich type of contact arrangement from these contact plates with the PTC element (or several PTC elements) interposed between the plates, said contact arrangement being held together elastically. The contact plates are adapted to the plan shape of the PTC elements, and are held together by holding elements placed on the edges. The unified structure thus obtained ensures that such a contact arrangement can be manipulated without difficulty, but it does not ensure the application pressure between contact plates and PTC elements which is necessary for heat transfer. This pressure, which is necessary for operational reasons, is applied only when the arrangement is inserted in an appliance, by arranging for suitable appliance parts to clamp the contact arrangement.

An object of the present invention is to develop an electrical resistance heating element of the type initially indicated and discussed hereinbefore, to form a self-contained unit which can be used in a very wide range of applications, which guarantees optimum heat shedding from the PTC element independently of further measures when fitted, and can be manufactured in a simple and inexpensive manner.

According to the present invention there is provided an electrical resistance heating element, comprising at least one heating conductor in the form of an element which is provided at opposite surfaces with an electrical contacting means and is made of a material having a positive temperature coefficient of electrical resistance (PTC element), and further comprising two substantially plane contact plates, the contact plates being held together with the PTC element interposed between them to form a single unit acting as a contact arrangement, and a sleeve of electrically insulating heat conductive material having an inner space whose internal cross-section is adapted to the cross-section of the contact arrangement, the contact arrangement being inserted into the inner space in the sleeve under a pressure perpendicular to the plane of the contact plates.

The sleeve proposed according to the invention is, as the term implies, closed circumferentially and comprises an interior space which is open at at least one end for the insertion of the contact arrangement. The outer surface of the sleeve can be substantially optionally shaped in accordance with mounting or fitting conditions in an appliance, more particularly being given a cylindrical shape in one constructional form as a "heating cartridge" for example, in which case the inner space extends parallel to the axis of the cylinder. Since the widths of the contact plates and the PTC element are normally substantially identical, the cross-section of the contact arrangement is substantially rectangular and correspondingly the inner space usually has an internal cross-section of a rectangular shape, which is substantially constant over the length of the inner space. In the width direction the inner space and contact arrangement are so dimensioned that the said arrangement can be pushed-in without difficulty. On the other hand, as will be clear from the foregoing, as regards the height of the inner space and contact arrangement the adaption is such as to bring about pressure perpendicularly to the plane of the contact plates, this pressure ensuring that the contact plates abut tightly on the PTC element with low transfer or contact resistance for current and heat.

The pressure application force is taken up by the sleeve, and on the other hand the contact plates are pressed with their full surface area against the wall of the inner space, so that good heat transfer to the outside of the sleeve results. The pressure is produced by giving the inner space slightly smaller dimensions in the sense of height relatively to the contact arrangement, the amount of undersize depending substantially on the compressive strength of the PTC elements and the elastic properties of the sleeve material, and the necessary amount can be determined by simple experiments. After the insertion of the contact arrangement the inner space can be filled up additionally by casting into it an electrically insulating, heat conductive material such as, for example, heat conductive silicone rubber, to obtain optimum heat dissipation from the side surfaces of the PTC element also.

Of course it is also possible to provide the PTC element in a composite form by arranging a plurality of PTC elements in series, behind one another and/or adjacent to one another (side by side) between the contact plates.

Current is supplied with the use of connecting leads which can be secured to the rear ends of the contact plates (considered in the insertion section) by soldering, spot welding, terminal clips or the like.

As will be clear from the foregoing, according to the invention the pressure between contact plates and PTC element is produced by the elasticity of the sleeve. Particularly advantageous adaption can be achieved is the sleeve consists of elastomeric material, for example heat conductive silicone rubber. In every case the sleeve can consist of a length of tubular extruded material of suitable cross-section, and used open at both ends or subsequently closed at the end. But preferably the sleeve is cast or moulded as a part closed at one end.

In order to facilitate insertion of the contact plates can be given a slightly wedge-shaped form. But in this and other respects it is particularly advantageous to use a constructional form wherein the contact plates are constructed as heat-emitting surfaces, project beyond the PTC element in the longitudinal direction at at least one side, and are completely enclosed by the sleeve. With the contact plates (which in every case should consist of material which is a good conductor of heat such as copper or aluminium) are constructed in this way, the heat transfer from the PTC element to the sleeve is substantially improved, and thus also the heat transfer from the outer surface of the sleeve to the heat-using device or medium. Moreover if the contact plates project beyond the PTC element at least at the front side considered in the insertion direction, they can be introduced into the inner space in a wedge-shaped formation inclined relatively to one another. As a result, insertion requires the application of only slight force, and yet a high pressure is achieved in the inserted state, in that the contact plates abut over the whole surface on the PTC element because of the elasticity of the sleeve material. Preferably the contact plates project beyond the PTC element at least to an extent corresponding to the length of the said element.

A further advantageous form is characterised in that the sleeve comprises a spacer web extending axially within the inner space, and a guide duct for one of the contact plates is formed in each case between the respective neighbouring inner wall of the sleeve and the opposite side of the spacer web, one duct for each plate. Spacer web and guide ducts are so dimensioned that the portions of contact plates projecting beyond the PTC element abut on the spacer web and on the sleeve wall with elastic application pressure, with further improvement of the heat transfer. The spacer web can be formed in the sleeve in a simple manner, when the sleeve is being cast or moulded, integrally with the sleeve and starting from the closed sleeve end, and preferably merging into the sleeve wall at the sides. In other words, in this constructional form the sleeve comprises, after the inner space, a solid end portion in which the guide ducts are formed.

It is also advantageous in the case of this constructional form to make the guide ducts diverge in the direction of insertion of the contact arrangement. This results in the front ends of the contact plates being opened out from one another on entry into the guide ducts, so that as a result of the rear ends of the contact plates, between which the PTC element lies, are pressed together because of the lever effect. This measure results in an overall better heat transfer between the contact plates and the sleeve and uniformity of heat transfer over the length of the contact plates.

The manipulation of the contact arrangement, more particularly in the insertion operation, can be simplified by embedding the rear ends of the contact plates, considered in the insertion direction, in a holding element made of electrically insulating material, preferably likewise heat conductive silicone rubber. At the same time the holding element provides tension relief for the connection leads connected to the contact plates. Preferably the holding element is so constructed that it closes and seals the inner space of the sleeve when the contact arrangement is inserted.

Figure 2:
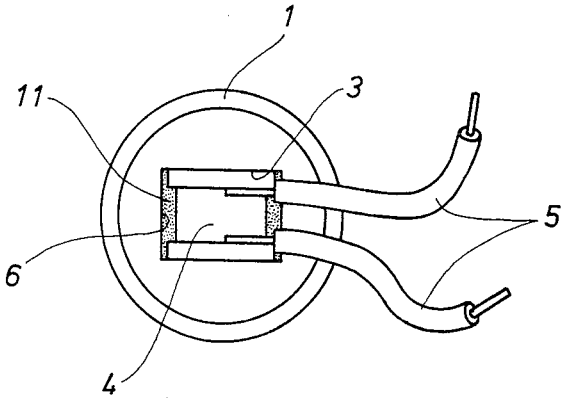

The invention will be discussed in detail hereinafter with reference to drawings showing one constructional example, in which:

FIG. 1 shows an electrical resistance heating element in longitudinal section, FIG. 2 shows the subject of FIG. 1 in an end view with the holding element eliminated to reveal the interior of the heating element.

A "cartridge" type of electrical resistance heating element is shown in the Figures. It comprises substantially a sleeve 1 of heat conductive silicone rubber and a contact arrangement 2 which is inserted into the interior of the sleeve 1. The contact arrangement 2 is assembled from two flat contact plates 3 made of copper and a PTC element 4 which is interposed between the contact plates 3 and is provided at its surfaces facing towards the contact plates 3 with an electrical contacting layer or other contacting means (not shown). The contact plates 3 are of the same width as the PTC element substantially—apart from a light amount of oversize (see FIG. 2). The PTC element 4 is supplied with current by way of the contact plates 3 by means of connection leads 5 soldered or otherwise bonded to the ends of the contact plates 3.

The sleeve 1, cast or moulded from heat conductive silicone rubber, is closed at one end and comprises an inner space 6 of rectangular cross-section (see FIG. 2) which is open towards the other end and into which the contact arrangement 2 is inserted. In the width direction the inner space 6 allows the contact arrangement 2 a certain amount of clearance. In the vertical direction at right angles to the plane of the contact plates, on the contrary, the inner space 6 is so dimensioned that in the fitted state the contact arrangement 2 is pressed together because of the elasticity of the sleeve 1. Externally the sleeve 1 is of circular cylindrical shape.

As FIG. 1 shows, the contact plates 3 project beyond the PTC element at the front side in the insertion direction (arrow 7) by more than twice the length of the said element. The length of the contact plates 3 thus corresponds approximately to the length of the sleeve 1, so that a good, uniform heat transfer over a considerable surface area is achieved.

Between the portions of the contact plates 3 which project beyond the PTC element 4 there engages a spacer web 8 which is integrally formed on to the closed end of the sleeve 1 when the said sleeve is cast or moulded, and the said web projects into the inner space 6, merges into the wall of the sleeve 1 laterally, and leaves free between itself and the wall of the sleeve 1, in the height direction, guide ducts 9 into which the contact plates 3 engage. The guide ducts 9 are given narrower dimensions than the contact plates 3, so that in the inserted state the spacer web 8 and the wall of the sleeve 1 abut with elastic pressure on the contact plates 3, so that good heat transfer is ensured. The guide ducts 9 may be formed to diverge slightly in the insertion direction 7, as previously mentioned herein; this feature is not illustrated in the drawings as it can be readily visualized having regard to the advantageous effect thereof previously mentioned herein.

At the outer end (the rear end in the insertion direction 7) the contact plates 3 are embedded in a holding element 10 of heat conductive silicone rubber which at the same time acts as a strain relief means for the connection leads 5. The holding element 10 is so dimensioned that it closes and seals the inner space 6 in the fitted position (shown in FIG. 1) of the contact arrangement 2.

If a holding element 10 closing the inner space 6 is not provided, after the contact arrangement 2 has been inserted the remaining space inside the sleeve (shown in FIG. 2.) can be filled with an electrically insulating, readily heat conductive, casting material 11—again, for example, heat conductive silicone rubber.

What is claimed is:

1. Electrical resistance heating element comprising a contact arrangement having at least one heating conductor in the form of an element which is provided at opposite surfaces with an electrical contacting means and is made of a material having a positive temperature coefficient of electrical resistance (PTC element), and two substantially planar contact plates, the PTC element being interposed between said plates; a sleeve of elastically flexible, electrically insulating, heat conductive material having an inner space whose internal cross-section is slightly smaller height-wise relative to the cross-section of the contact arrangement, the contact arrangement being inserted into the inner space in the sleeve and held therein, with the contact plates pressed against the PTC element, under a pressure perpendicular to the plane of the contact plates created by elastic compression of the sleeve by the contact arrangement, wherein the full surface area of one side of each of said contact plates presses directly against an inner wall of the sleeve defining said inner space; and sealing means for sealing said inner space.

2. Resistance heating element according to claim 1, wherein the sleeve consists of elastomeric material.

3. Resistance heating element according to claim 1, wherein the contact plates are constructed as heat discharging surfaces, project beyond the PTC element in the longitudinal direction at at least one end, and are surrounded completely by the sleeve.

4. Resistance heating element according to claim 1, wherein the sleeve has a spacer web which extends axially within the inner space, and wherein guide ducts, one for each of the contact plates, are arranged between opposite sides of the spacer web and the respective neighbouring inner wall of the sleeve.

5. Resistance heating element according to claim 4, wherein the guide ducts diverge in the direction of insertion of the contact arrangement.

6. Resistance heating element according to claim 1, wherein the rear ends of the contact plates as considered in the direction of insertion are embedded in a holding element consisting of electrically insulating material.

7. Resistance heating element according to claim 6, wherein the holding element closes and seals the inner space of the sleeve when the contact arrangement is in the inserted state.

* * * * *